US006041565A

United States Patent [19]

Reitz et al.

[11] Patent Number: 6,041,565

[45] Date of Patent: Mar. 28, 2000

[54] DOOR FRAME

[75] Inventors: Raymond Reitz, St. Fargeau; Patrick Dubreuil, Thomery, both of France

[73] Assignee: Inventio AG, Hergiswil NW, Switzerland

[21] Appl. No.: 08/855,194

[22] Filed: May 13, 1997

[30] Foreign Application Priority Data

May 13, 1996 [EP] European Pat. Off. ..... 96810300

[51] Int. Cl.[7] ..... E04C 2/38

[52] U.S. Cl. ..... 52/656.4; 52/204.1; 52/656.2; 52/656.9; 49/504

[58] Field of Search ..... 52/204.1, 656.2, 52/656.4, 656.9; 49/504

[56] References Cited

U.S. PATENT DOCUMENTS

| | | | |
|---|---|---|---|
| 1,327,441 | 1/1920 | Mesker et al. . | |
| 2,741,344 | 4/1956 | Herr | 52/656.4 X |
| 3,769,773 | 11/1973 | Mochizuki | 52/656.4 |
| 4,021,988 | 5/1977 | Edeus et al. | 52/656.4 |
| 5,581,953 | 12/1996 | Ruff | 52/656.4 X |

FOREIGN PATENT DOCUMENTS

| | | |
|---|---|---|
| 8121/66 | 7/1969 | Australia . |
| 0 018 054 | 4/1980 | European Pat. Off. . |
| 25 48 003 | 4/1977 | Germany . |
| 29 24 442 | 6/1979 | Germany . |
| 556752 | 10/1943 | United Kingdom . |
| 83/03873 | 11/1983 | WIPO . |
| 95/32912 | 12/1995 | WIPO . |

*Primary Examiner*—Christopher Kent
*Attorney, Agent, or Firm*—MacMillan, Sobanski & Todd

[57] ABSTRACT

A door frame having a threshold element (1), a pair of door posts (2) and a lintel element (3) connected together mechanically positively and non-detachably in pluggable manner. Tongues (28, 30, 32, 34) of the lintel element (3) are plugged into slots (37, 38, 39, 40) of the door posts (2) and an additional element (45) is pushed at the door post end onto the tongues. Thereafter, the additional element (45) is moved downwardly, wherein tongues (47, 49, 50, 51) of the additional element detent in slots (29, 31, 33, 35) of the lintel element (3). The upward movement of the additional element (45) is prevented by a tongue (44) that is bent into a recess (42) of the door post (2).

6 Claims, 4 Drawing Sheets

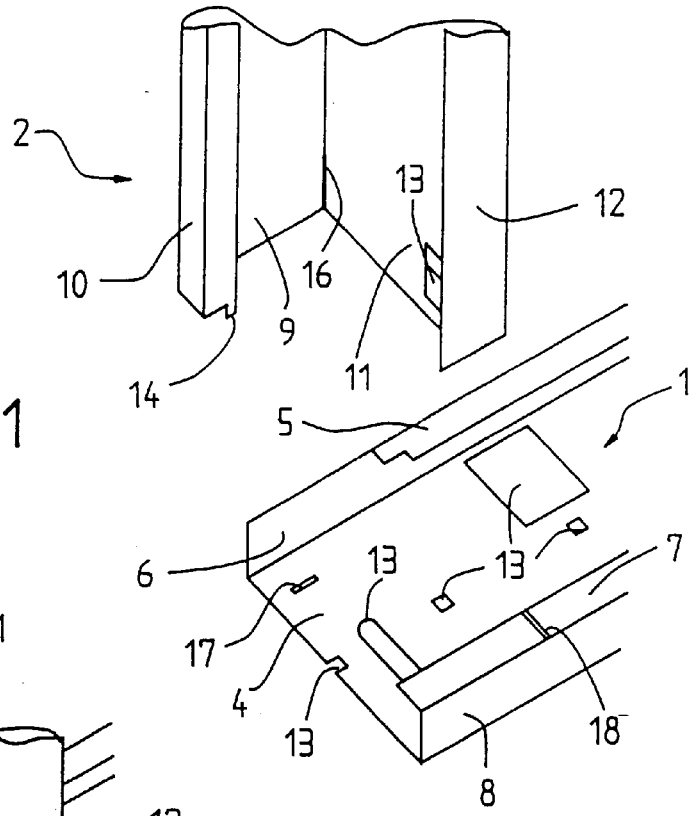
Fig. 1
Fig. 2
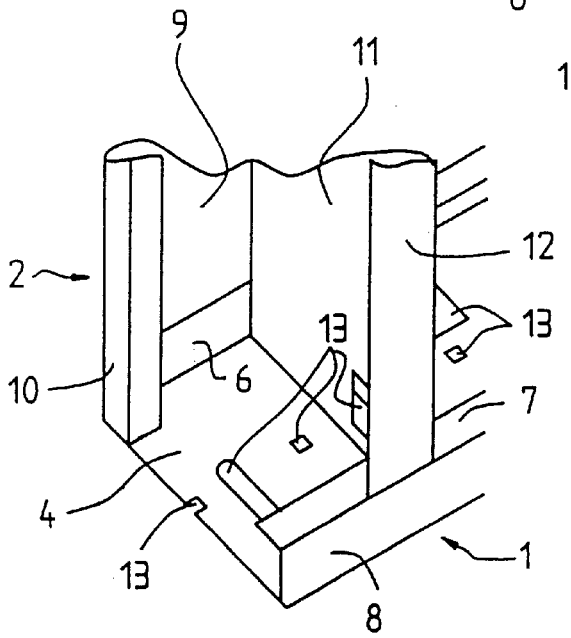
Fig. 4
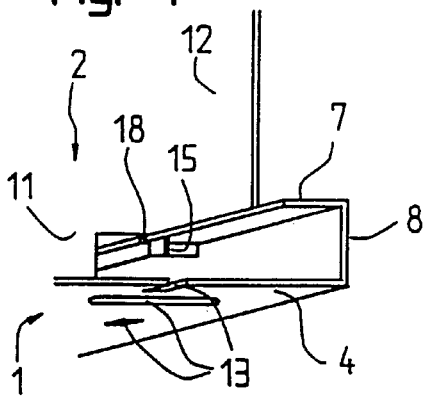
Fig. 3
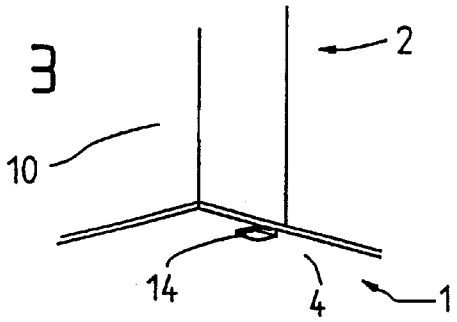

DOOR FRAME

BACKGROUND OF THE INVENTION

The present invention relates generally to a door frame and, in particular, to an elevator door frame consisting of frame elements, which are connectable by means of connecting means.

Frame elements for a door, which are detachably connected by means of a connecting bracket, have become known from the published specification International Publication Number WO 95/32912. Two door posts and a transom element form the door frame. The L-shaped connecting bracket has bores at a long limb and elongate slots at a short limb. The long limb of the connecting bracket is screw-connected with a further connecting bracket, which is connected with a door post and additionally stiffens this. The transom element, at which a door drive is arranged, stands in screw connection with the long limb and with the short limb of the connecting bracket. A her connecting bracket with elongate slots, by means of which the frame construction is fixed to a wall, is screw-fastened to the short limb.

A disadvantage of the known equipment is that connecting brackets, which are expensive in manufacture and cause a high assembly effort, are necessary for the connection of the frame elements. It is also a disadvantage that the screws and nuts used as connecting means can loosen, which can have serious consequences, for example in the case of a frame for an elevator door.

SUMMARY OF THE INVENTION

The present invention concerns a door frame having a threshold element, a lintel element and a pair of door posts extending between the threshold element and the lintel element. A first plurality of connecting means for connecting the threshold element to the door posts includes at least one deformable tongue formed on each of the door posts and a corresponding slot formed in the threshold element whereby the one tongue is inserted into the slot and deformed to mechanically connect the threshold element with the door posts. A second plurality of connecting means for connecting the lintel element to the door posts includes at least another deformable tongue formed on the lintel element and a corresponding slot formed in each of the door posts whereby the tongue is inserted into the slot and deformed to mechanically connect the lintel element to the door posts. The door frame also includes an additional element having at least one deformable tongue formed thereon and the lintel element has at least one slot formed therein whereby the additional element tongue is inserted into the lintel element slot and deformed to mechanically connect the lintel element with the door posts.

The invention meets the object of avoiding the disadvantages of the known equipment and of proposing a door frame with pluggable frame elements which are non-detachably connected together.

The advantages achieved by the invention are to be seen essentially in that expensive assembly operations such as welding, screwing, riveting and so forth become superfluous and thus substantial assembly costs can be saved. Moreover, the door frame according to the invention can be built more precisely without the assembly gauges necessary for the conventional connecting means, because the frame elements with their fixings are mechanically producible in one piece. Thanks to the simple manner of connection, the door frame is lighter, can be transported disassembled and put together on site.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is an exploded fragmentary perspective view of a two frame elements to be connected together in accordance with the present invention;

FIG. 2 is a view similar to the FIG. 1 showing the two frame elements in connection with one another;

FIG. 3 and FIG. 4 are bottom perspective views of the details of the connected frame elements shown in the FIG. 2;

DESCRIPTION OF THE PREFERRED EMBODIMENT

Figure 5:
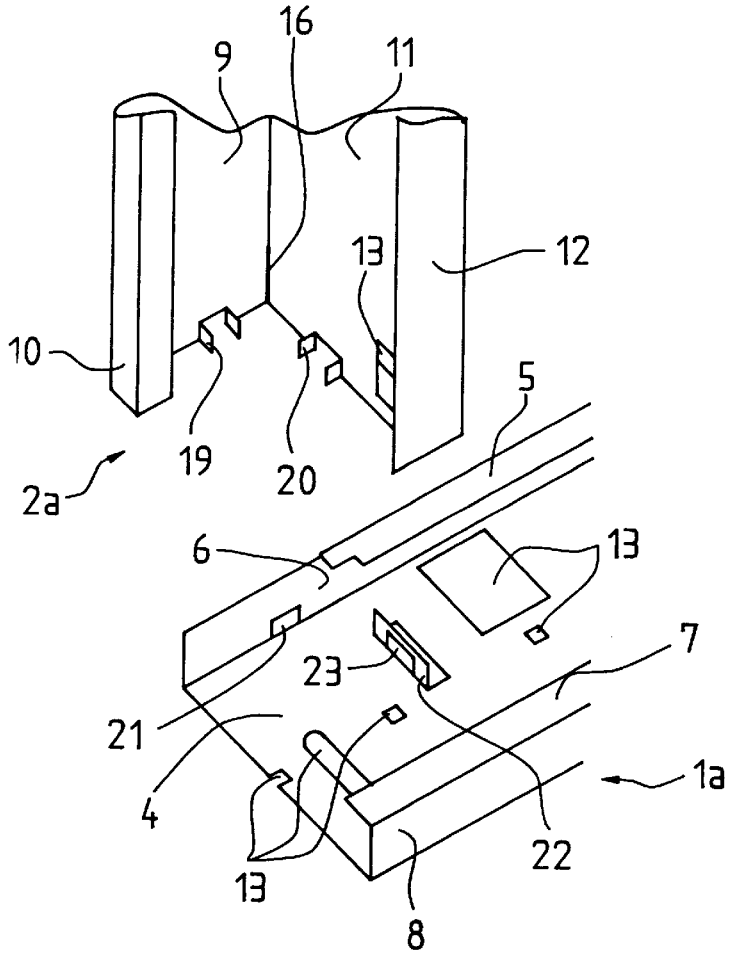
FIG. 5 is a view similar to the FIG. 1 showing an alternate embodiment of embodiment of the frame elements to be connected.

A door frame consisting of four frame elements is illustrated in the FIGS. 1–11, wherein a threshold element 1 at the bottom, a door post 2 for each side and a lintel element 3 at the top are provided as frame elements and wherein the door posts 2 stand on the threshold element 1 and the lintel element 3 is arranged between the door posts 2.

In the FIGS. 1 through 4, the threshold element 1 has a U-shaped profile section with a base 4, with a first collar 5 of a first longitudinal side 6 and with a second collar 7 of a second longitudinal side 8. The door post 2 is L-shaped and has a third collar 10 at a first leg 9 and a fourth collar 12 at a second leg 11. Recesses and apertures, which are necessary for assembly, formed in the threshold element 1, the door post 2 and the lintel element 3 are denoted by 13. A first tongue 14 is arranged on the third collar 10 of the door post 2 and a second tongue 15 is arranged on the second leg 11 of the door post 2. In that corner of the door post 2 which is formed by the first leg 9 and the second leg 11 an incision or slot 16 is provided at the level of the first longitudinal side 6 of the threshold element 1. The base 4 of the threshold element 1 has a first slot 17 and the second collar 7 has a second slot 18. The first collar 5 of the first longitudinal side 6 is cut back by the width of the first leg 9 of the door post 2.

During assembly, the first tongue 14 is plugged into the first slot 17 and the second tongue 15 into the second slot 18, wherein the first leg 9 of the door post 2 engages behind the first longitudinal side 6 of the threshold element 1 in the cut-back region of the first collar 5. Then, the first tongue 14 and the second tongue 15 are deformed as shown in the FIGS. 3 and 4, whereby the threshold element 1 is mechanically positively and non-detachably connected with the door post 2.

Figure 6:
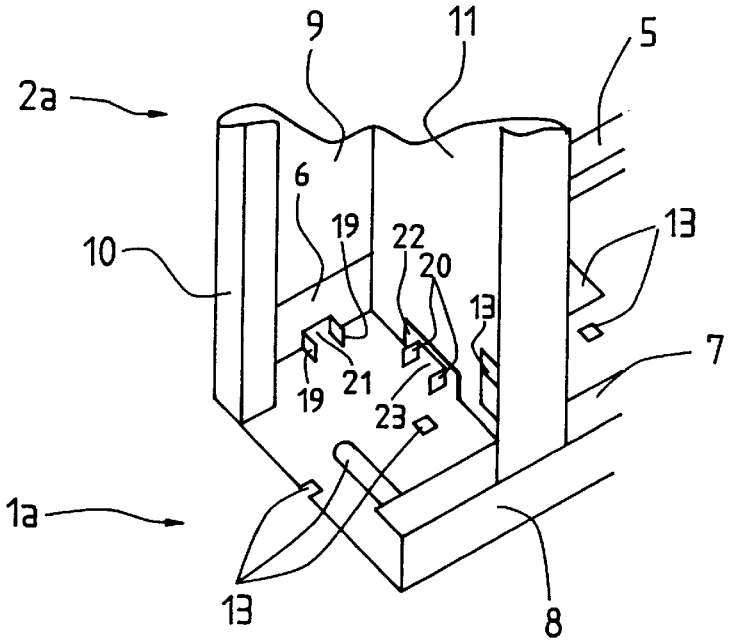
FIG. 6 is a view similar to the FIG. 5 showing the two frame elements in connection with one another.

A further variant or alternate embodiment for the connection of a threshold element 1*a* with a door post 2*a* is illustrated in the FIGS. 5 and 6. On the door post 2*a*, the first leg 9 has a first double tongue 19 and the second leg 11 has a second double tongue 20 formed at the lower edges thereof. A first recess 21, which fits the first double tongue 19, is arranged at the first longitudinal side 6 of the threshold element 1*a*. A first bracket 22, which is punched out of the base 4 of the threshold element 1*a*, has a second recess 23 formed therein for receiving the second double tongue 20. During assembly, the double tongues 19 and 20 are plugged through the recesses 21 and 23 respectively as shown in the FIG. 6, and deformed whereby the threshold element 1*a* is mechanically positively and non-detachably connected with the door post 2*a*. In a further variant for the connection of the threshold element with the door post, the connection variant 1, 2 of the FIGS. 1 through 4 can be combined with the connection variant 1*a*, 2*a* of the FIGS. 5 and 6.

Figure 7:
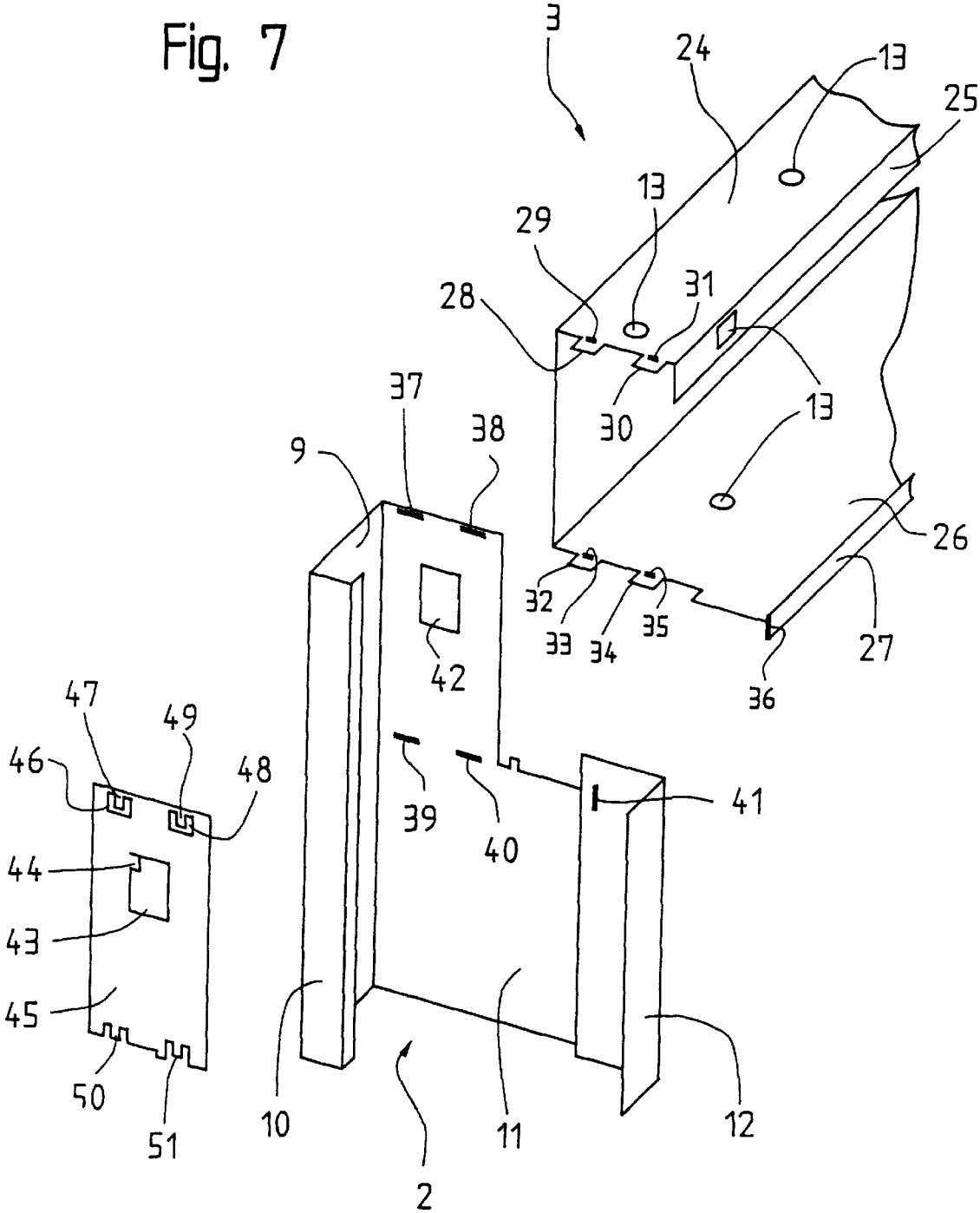
FIG. 7 is an exploded fragmentary perspective view showing a second alternate embodiment of the frame elements to be connected.
Figure 8:
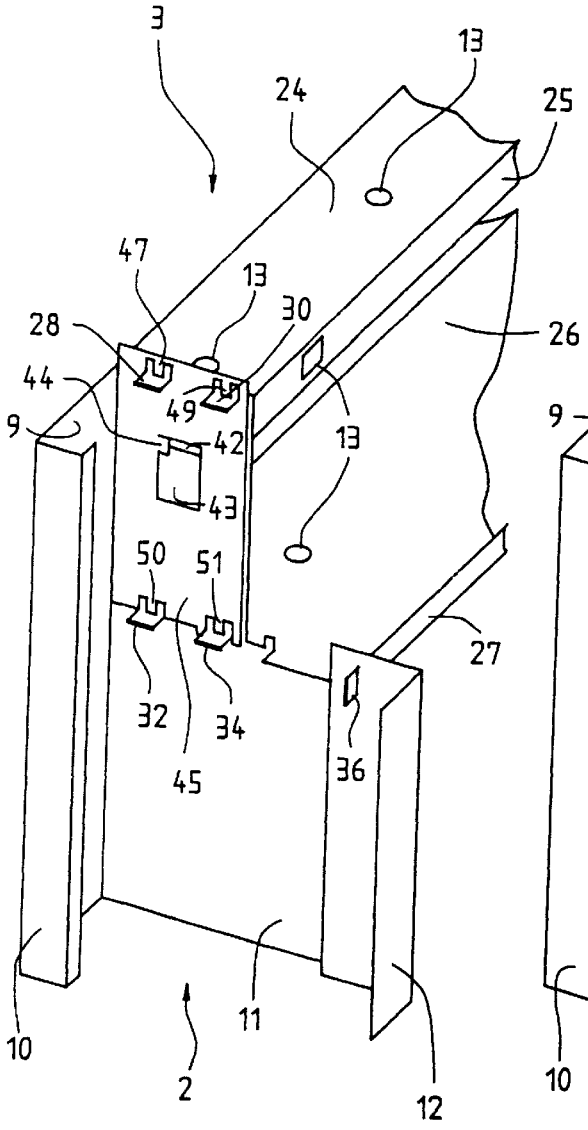
FIG. 8 is a view similar to the FIG. 7 showing the two frame elements in conjunction with an additional element.
Figure 9:
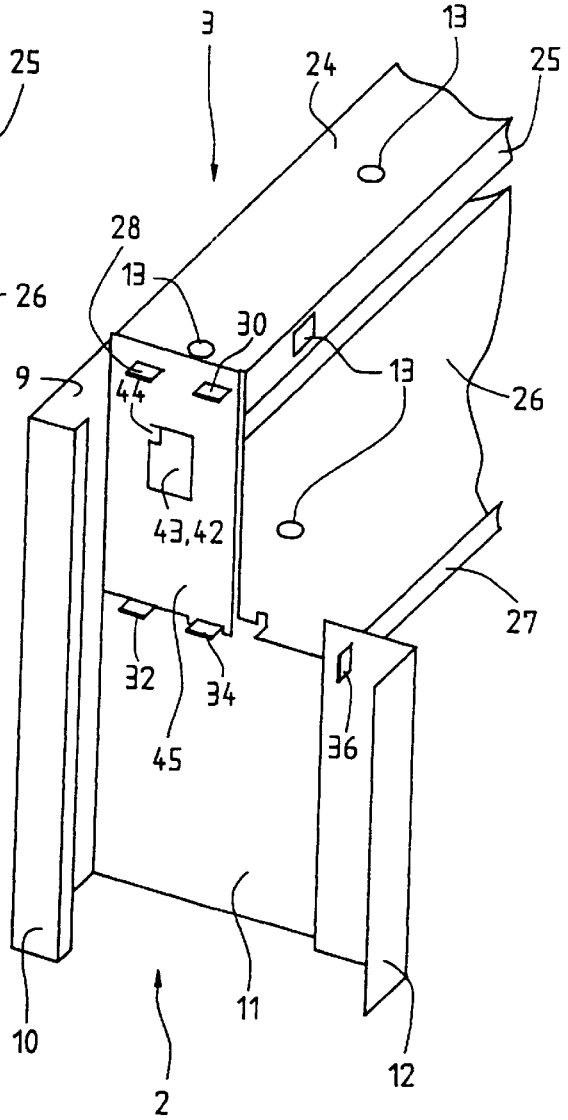
FIG. 9 is a view similar to the FIG. 8 showing the two frame elements secured by means of the additional element.

An example of an embodiment for the connection of the door post 2 with the lintel element 3 is shown in the FIGS. 7 through 9. The U-shaped lintel element 3 has a third longitudinal side 24 with a third collar 25 and a fourth longitudinal side 26 with a fourth collar 27. At the end face, the third longitudinal side 24 has a third tongue 28 with an adjacent third slot 29 and a fourth tongue 30 with an adjacent fourth slot 31. At the end face, the fourth longitudinal side 26 has a fifth tongue 32 with an adjacent fifth slot 33 and a sixth tongue 34 with an adjacent sixth slot 35. At the end face, the fourth collar 27 has a seventh tongue 36 formed thereon.

The lintel-side end of the door post 2 has a seventh slot 37, an eighth slot 38, a ninth slot 39, a tenth slot 40 and an eleventh slot 41 formed therein, wherein the seventh slot 37 fits the third tongue 28, the eighth slot 38 fits the fourth tongue 30, the ninth slot 39 fits the fifth tongue 32, the tenth slot 40 fits the sixth tongue 34 and the eleventh slot 41 fits the seventh tongue 36.

A third recess 42, which fits a fourth recess 43 with an eighth tongue 44 of an additional element 45, is arranged at the door post 2. A fifth recess 46 with a ninth tongue 47, a sixth recess 48 with a tenth tongue 49, an eleventh tongue 50 and a twelfth tongue S1 are arranged on the additional element 45, wherein the tongues and slots fit the corresponding slots and tongues of the lintel element 3.

During assembly, the tongues of the lintel element 3 are plugged into the slots of the door post 2 and the additional element 45 is pushed at the door post end onto the tongues of the lintel element 3, which project out of the slots 37, 38, 39 and 40 of the door post 2, as shown in the FIGS. 8 and 9. Thereafter, the additional element 45 is moved downwardly, wherein the tongues 47, 49, 50 and 51 of the additional element 45 detent in the slots 29, 31, 33 and 35 respectively of the lintel element 3. The upward movement of the additional element 45 is prevented by means of the eighth tongue 44 in that this is bent into the third recess 42 of the door post 2. The seventh tongue 36 is deformed at the door post end. The pluggable connection between the door post 2 and the lintel element 3 is mechanically positive and non-detachable.

Figure 10:
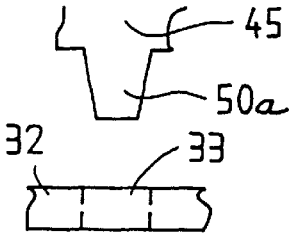
FIG. 10 is a plan view of a tongue of the additional element shown in the FIG. 8.
Figure 11:
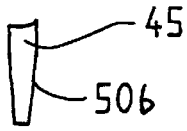
FIG. 11 is a side elevation view of the tongue shown in the FIG. 10.

The FIG. 10 shows an alternate embodiment tongue 50*a* of the additional element 45. The tongue 50*a* is reduced in width towards its free end, i.e. it is slightly wedge-shaped. As shown in the FIG. 11, the free end of another alternate embodiment tongue 50*b* also can be shaped to be slightly wedge-shaped in thickness by flattening-off by means of a punching tool. The remaining tongues 44, 47, 49 and 51 of the additional element 45 can be constructed like the tongues 50*a* and 50*b*. The tongues 44, 47, 49, 50 and 51, when formed wedge-shaped in width and/or thickness, enable an easy introduction of the tongues into the corresponding slots 42, 29, 31, 33 and 35. Production tolerances can also be compensated for the wedge-shaped tongues 44, 47, 49, 50 and 51.

In summary, the door frame comprises the threshold element 1, the lintel element 3 and the pair of door posts 2 extending between the threshold element and the lintel element. A first plurality of connecting means for connecting the threshold element 1 to the door posts 2 includes at least one of the deformable tongues 14, 15, 19, 20 formed on each of the door posts and the corresponding slots 17, 18, 21, 23 formed in the threshold element whereby the one tongue is inserted into the slot and deformed to mechanically connect the threshold element with the door posts. A second plurality of connecting means for connecting the lintel element 3 to the door posts 2 includes at least another one of the deformable tongues 28, 30, 32, 34, 36 formed on the lintel element and a corresponding one of another slots 37, 38, 39, 40, 41 formed in each of the door posts whereby the another tongue is inserted into the another slot and deformed to mechanically connect the lintel element to the door posts. The door frame also includes the additional element (45) having the deformable tongues 47, 49, 50, 51 formed thereon and the lintel element 3 has at least one slot 29, 31, 33, 35 formed therein whereby the additional element tongue is inserted into the lintel element slot and deformed to mechanically connect the lintel element with the door posts.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A door frame comprising:

a threshold element (1*a*) extending between a bottom of a pair of door posts (2*a*) and a lintel element (3) extending between a top of said door posts;

a first connecting means for connecting said threshold element (1*a*) to said door posts (2*a*), said first connecting means including at least one pair of deformable threshold tongues (19, 20) formed on one of said threshold element and a first one of said door posts and a corresponding threshold recess (21, 23) formed in another one said threshold element and said first door post whereby said threshold tongues are inserted into said threshold recess and deformed to mechanically connect said threshold element with said first door post; and a second connecting means for connecting said lintel element (3) to said door posts (2*a*), said second connecting means including at least one deformable lintel tongue (28, 30, 32, 34, 36) formed on said lintel element and a corresponding lintel slot (37, 38, 39, 40, 41) formed in said first door post whereby said lintel tongue is inserted into said lintel slot and deformed to mechanically connect said lintel element with said first door post.

2. A door frame comprising:

a threshold element (1, 1*a*) extending between a bottom of a pair of door posts (2, 2*a*) and a lintel element (3) extending between a top of said door posts;

a first connecting means for connecting said threshold element (1, 1*a*) to said door posts (2, 2*a*), said first connecting means including at least one deformable threshold tongue (14, 15, 19, 20) formed on one of said threshold element and a first one of said door posts and a corresponding one of a threshold slot (17, 18) and a threshold recess (21, 23) formed in another one said threshold element and said first door post whereby said threshold tongues are inserted into said corresponding one of said threshold slot and said threshold recess and deformed to mechanically connect said threshold element with said first door post;

a second connecting means for connecting said lintel element (3) to said door posts (2*a*), said second connecting means including at least one deformable lintel tongue (28, 30, 32, 34, 36) formed on said lintel element and a corresponding lintel slot (37, 38, 39, 40, 41) formed in said first door post whereby said lintel tongue is inserted into said lintel slot and deformed to mechanically connect said lintel element with said first door post; and an additional element (45) having at least one deformable additional element tongue (47, 49, 50, 51) formed thereon and wherein said lintel element (3) has at least one additional element slot (29, 31, 33, 35) formed therein whereby said additional element is positioned on an opposite side of said first door post from said lintel element and said additional element tongue is inserted into said additional slot and deformed to mechanically connect said lintel element with said first door post.

3. A door frame comprising:

a threshold element (1*a*) extending between a bottom of a pair of door posts (2*a*) and a lintel element (3) extending between a top of said door posts;

a first connecting means for connecting said threshold element (1*a*) to said door posts (2*a*), said first connecting means including at least one pair of deformable threshold tongues (19, 20) formed on one of said threshold element and a first one of said door posts and a corresponding threshold recess (21, 23) formed in another one said threshold element and said first door post whereby said threshold tongues are inserted into said threshold recess and deformed to mechanically connect said threshold element with said first door post;

a second connecting means for connecting said lintel element (3) to said door posts (2*a*), said second connecting means including at least one deformable lintel tongue (28, 30, 32, 34, 36) formed on said lintel element and a corresponding lintel slot (37, 38, 39, 40, 41) formed in said first door post whereby said lintel tongue is inserted into said lintel slot and deformed to mechanically connect said lintel element with said first door post; and an additional element (45) having at least one deformable additional element tongue (47, 49, 50, 51) formed thereon and wherein said lintel element (3) has at least one additional element slot (29, 31, 33, 35) formed therein whereby said additional element is positioned on an opposite side of said first door post from said lintel element and said additional element tongue is inserted into said additional slot and deformed to mechanically connect said lintel element with said first door post.

4. The door frame according to claim 3 wherein said threshold tongue (19, 20) is formed integral with said first door post (2*a*) and said threshold recess (21, 23) is formed in said threshold element.

5. The door frame according to claim 3 wherein said additional element (45) has a post tongue (44) formed thereon and said first door post (2*a*) has a post recess (42) formed therein whereby said post tongue is inserted into said post recess and deformed to mechanically connect said additional element with said first door post.

6. The door frame according to claim 3 wherein additional element tongues (47, 49, 50, 51) are reduced in at least one of width and thickness towards a free end thereof.

* * * * *